United States Patent [19]

McAllister

[11] 4,337,593

[45] Jul. 6, 1982

[54] ANATOMICALLY MANIPULABLE ROTATABLE IMPLEMENT

[76] Inventor: Wesley J. McAllister, 11254 Exeter St., Loma Linda, Calif. 92354

[21] Appl. No.: 86,552

[22] Filed: Oct. 19, 1979

[51] Int. Cl.[3] ..... A63H 1/00

[52] U.S. Cl. ..... 46/64; 46/47; 272/67; 272/127

[58] Field of Search ..... 46/50, 47, 64, 65, 67, 46/71, 72, 73, 49, 60, 209, 220; 273/147; 272/146, 67, 127; 74/5 R

[56] References Cited

U.S. PATENT DOCUMENTS

| | | | |
|---|---|---|---|
| 461,948 | 10/1891 | Wilson | 46/50 X |
| 484,960 | 10/1892 | Hardy | 74/5 R X |
| 1,005,853 | 10/1911 | Lewis | 46/236 |
| 1,724,665 | 8/1929 | Kochi | 46/64 |
| 2,794,294 | 6/1957 | Frangos | 46/50 X |

FOREIGN PATENT DOCUMENTS

| | | | |
|---|---|---|---|
| 616859 | 1/1949 | United Kingdom | 272/127 |

*Primary Examiner*—Gene Mancene
*Assistant Examiner*—Mickey Yu
*Attorney, Agent, or Firm*—Townsend and Townsend

[57] ABSTRACT

An anatomically manipulable toy in the form of a rotatable implement comprising a shaft, a massive body portion rigidly attached to the shaft, and a contact element at one end of the shaft. In operation, the rotating implement is generally supported by placing the contact element on a portion of the user's anatomy, typically a hand, with the shaft horizontal, rotation having been initiated by manually imparting a torque to the implement, typically at the shaft. The contact element rolls on the user's anatomy, thereby producing a linear translation therealong. The weight of the implement acting at a horizontal separation from the point of contact causes a precession of the spinning implement about the vertical axis through the point of contact. The rate of precession depends on the rate of angular rotation and the distance of horizontal separation. Thus, the rotating implement precesses at a controllable rate relative to the rate of linear translation, allowing the implement to circumscribe a portion of the anatomy such as the palm, or travel along the arm as the user rotates the arm. The dimensions and mass distribution of the device are characterized by three dimensional parameters, namely the radius of gyration R, the axial distance L between the center of gravity of the device and the point of contact between the contact element and the user's anatomy, and the diameter D of the contact element. The quantity $L/(R^2D)$ is preferably in the range of 0.05–0.11 reciprocal inches squared (hereinafter sometimes $inch^{-2}$).

13 Claims, 10 Drawing Figures

ANATOMICALLY MANIPULABLE ROTATABLE IMPLEMENT

FIELD OF THE INVENTION

The present invention relates generally to toys, and more specifically to the type of toy having an operation whose complexity and duration depend on the adroitness of the user.

BACKGROUND OF THE INVENTION

Rotating objects have fascinated countless generations of children and adults, and one need not look far in the art to find numerous examples of toys whose operation incorporates a rotating element. The top, the flying saucer, the hula-hoop, and the yo-yo are but a few examples of such toys.

The key to a toy's long-term success is its ability to maintain the interest of the user as the user's dexterity and skill improve. This in effect presents a dual requirement on the toy. Unless a beginner can quickly master the rudiments of the toy's operation, he is likely to become discouraged and abandon efforts to perfect his skill. In such a case, the toy can scarcely be said to have universal appeal. Conversely, a toy that is capable of a limited number of maneuvers, or perhaps only simple maneuvers, fails to hold the interest of a user for more than a short period of time. To some extent, skill is correlated with age, and the most appealing toy is one that is capable of gratifying and challenging users of all ages. Every year, while numerous new toys enter the marketplace, the number of toys that have long-term appeal to people over a wide age range remains surprisingly small.

SUMMARY OF THE INVENTION

The present invention provides an anatomically manipulable toy that requires relatively little dexterity for initial use and mediocre coordination for execution of fundamental skills, but that elicits continued development of dexterity for progressive proficiency of operation. Once the basic skills are mastered, the present invention continues to challenge the imagination of the creative, the coordination of the dexterous, and the finesse of the graceful.

Broadly, the present invention provides a rotatable implement comprising a shaft, a massive body portion rigidly attached to the shaft, and a contact element at one end of the shaft. The body portion typically assumes the configuration of a generally circular plate-like element or spoked wheel. The contact element typically has cylindrical symmetry about the shaft and, depending on the shaft diameter, may be defined solely by the shaft end itself. In operation, the rotating implement is generally supported by placing the contact element on a portion of the user's anatomy, typically a hand, with the shaft horizontal, rotation having been initiated by manually imparting a torque to the implement, typically at the shaft. The contact element rolls on the user's anatomy, thereby producing a linear translation therealong. The weight of the implement acting at a horizontal separation from the point of contact causes a precession of the spinning implement about the vertical axis through the point of contact. The rate of precession depends on the rate of angular rotation and the distance of horizontal separation. Thus, the rotating implement precesses at a controllable rate relative to the rate of linear translation, allowing the implement to circumscribe a portion of the anatomy such as the palm, or travel along the arm as the user rotates the arm.

The dimensions and mass distribution of the device are characterized by three dimensional parameters, namely the radius of gyration (defined primarily by the mass distribution of the body portion), the axial distance between the center of gravity of the device and the point of contact between the contact element and the user's anatomy, and the diameter of the contact element. These dimensions will be referred to as R, L, and D, respectfully.

During operation of the device, the motion is characterized by three kinematic quantities, namely the angular velocity of the device about the shaft axis, the precessional angular velocity about a vertical axis, and the translational velocity of the contact element rolling on the user's anatomy. These quantities are referred to as $\omega$, $\Omega$, and v, respectively. These kinematic quantities are not independent, but are related by the dimensional parameters and the laws of physics governing precession of rigid bodies. As will be seen in greater detail below, these relationships plus certain human body dimensions place effective constraints on these parameters. For example, the quantity $L/(R^2D)$ is preferably in the range of 0.05–0.11 reciprocal inches squared (hereinafter sometimes $\text{inch}^{-2}$).

Within these dimensional constraints, dictated largely by a desire to avoid unduly strenuous operation, the device may be constructed in any chosen manner. For example, the body portion may assume the form of a spoked wheel integrally fabricated from plastic and having a central aperture for accommodating the shaft. The contact element may be integrally formed with the shaft, but is preferably detachable therefrom, and may be fabricated from semi-soft rubber or the like.

In addition to maneuvers wherein the shaft-end element is in continuous contact with the user's anatomy, as for example where the shaft-end element circumscribes a hand of the user, the device is capable of being used to execute flight maneuvers. Tossing the implement is generally effected while maintaining the axis of rotation substantially horizontal, and is accomplished by partially closing the fingers of one hand around the shaft of the rapidly rotating implement, accelerating the forearm in the intended direction of flight so that the loosely constrained implement is propelled therewith, and releasing the shaft to project the implement. Catching the rotating implement is accomplished by placing some part of the anatomy underneath the contact element of the flying implement, and moving that part of the anatomy with the implement in the direction of flight to gradually reduce linear velocity without appreciably retarding the rotational velocity.

Thus it can be seen that the present invention provides a surprisingly simple and inexpensive toy that is capable of a great variety of maneuvers and operations and which provides a user with an immediate and continuing challenge. For a further understanding of the nature and advantages of the present invention, reference should be made to the remaining portions of the specification and the attached drawings.

DETAILED DESCRIPTION OF THE INVENTION

Figure 1:
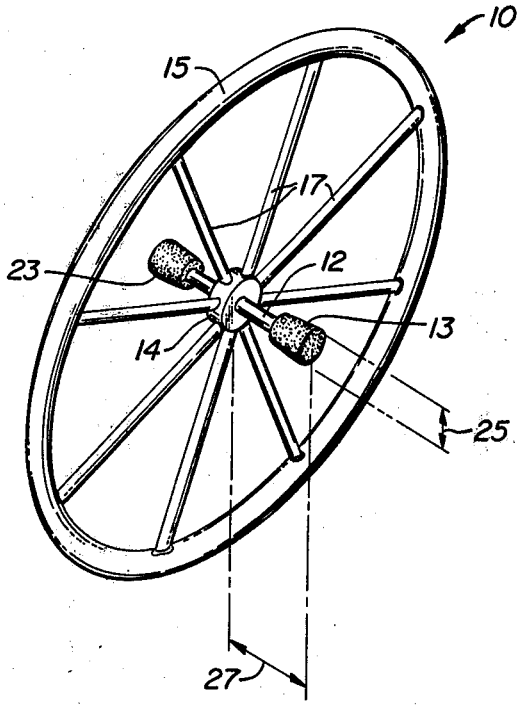
FIG. 1 is a perspective view of an implement according to the present invention.

FIG. 1 is a perspective view of a rotatable implement 10 according to the present invention. Broadly, implement 10 comprises a shaft 12, a massive body mounted on the shaft, and a contact element 13 on one end of the shaft. In a first embodiment, the massive body assumes the form of a wheel having a hub 14 mounted on shaft 12, an outer rim 15, and a plurality of radially extending spokes 17 connecting hub 14 and rim 15 in a coaxial arrangement. Contact element 13 is preferably a frustoconical bushing at an end of shaft 12 displaced from hub 14. Shaft 12 preferably extends completely through hub 14 and carries a second contact element 23 at its other end. Shaft 12 is preferably a relatively thin cylindrical rod formed from a rigid high strength material such as steel with a relatively low coefficient of friction. Contact elements 13 and 23 are preferably formed from a somewhat resilient material of relatively high coefficient of friction such as semi-soft rubber. Hub 14, rim 15, and spokes 17 are preferably formed integrally from a plastic material such as polystyrene or polypropylene. Hub 14 and contact elements 13 and 23 are fixedly mounted to shaft 12 so that relative rotation is avoided, but contact elements 13 and 23 may be made removable.

As will be described in detail below, operation of implement 10 involves a rotation about the axis of shaft 12 with contact element 13 contacting a portion of the user's anatomy and rolling therealong. This rotation, acted upon by a gravitational torque, causes implement 10 to precess about a vertical axis. Three dimensional variables determine the nature of the overall motion. The first dimensional variable is the radius of gyration, designated R, that is a function of the geometry and mass distribution of implement 10. Generally, it is preferred to have as much mass as possible at radially outermost portions to get as large a radius of gyration as possible for a given overall size of implement 10. For the configuration shown, a sizable fraction of the mass is concentrated at rim 15 so that the radius of gyration does not differ appreciably from the geometric radius of rim 15. The second dimensional variable is the diameter 25, designated D, of contact element 22 at the point where it contacts the user. The third dimensional variable is the distance 27 (moment arm), designated L, from the center of mass of implement 10 to the point of contact between contact element 22 and the user. Generally, for a symmetric implement operated with the shaft horizontal, this will be the distance from the medial plane to the outer axial surface of contact element 13.

Figure 2:
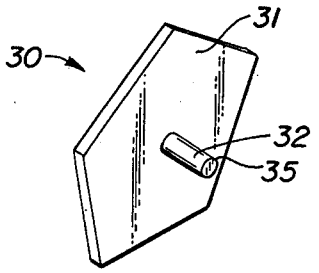
FIG. 2 is a perspective view of an alternate embodiment.

FIG. 2 shows an alternate embodiment of an implement 30 according to the present invention including a mass 31 affixed to a shaft 32 having an end 35. This embodiment differs from the embodiment of FIG. 1 in two respects. First, mass 31 has a decidedly non-circular configuration. Second, shaft 32 is devoid of any separate contact member such as contact element 13 so that end 35 defines the contact element. The discussion that follows will be made with reference to illustrations in which the embodiment of FIG. 1 is shown. However, it should be understood that a wide variety of geometrical configurations will be suitable. As will be developed below, the dimensional parameters R, D, and L are preferably constrained to certain internal relationships in order to allow a user to execute maneuvers.

FIGS. 3a–3g are sequential views showing positions that are assumed as a user 40 executes a maneuver during which contact element 13 of device 10 rolls along the periphery of the palm side of the user's left hand 42. FIGS. 3a–3g should be viewed in connection with FIG. 4 which is a plan view of left hand 42 of user 40 in which the successive positions of contact element 22 relative to hand 42 are shown in phantom. Hand 42 includes a palm 45, an index finger 46, a thumb 47, a little finger 48, and intermediate fingers 49. Palm 45 is partly bounded by an edge 50 remote from thumb 47 and generally collinear with little finger 48, and a heel portion 52 proximate the user's wrist. It should be noted that throughout this maneuver, hand 42 is not stationary, but rather rotates in a clockwise manner (looking from above). The maneuver is carried out with implement 10 rotating about a generally horizontal axis such that the gravitational torque caused by the displacement of the center of gravity from the point of support (that is, due to moment arm 27) causes an overall clockwise (looking from above) precession of implement 10 about a vertical axis. Hand 42 is at times rotated more quickly than the precession so that a relative counterclockwise movement of implement 10 occurs.

Figure 3A:
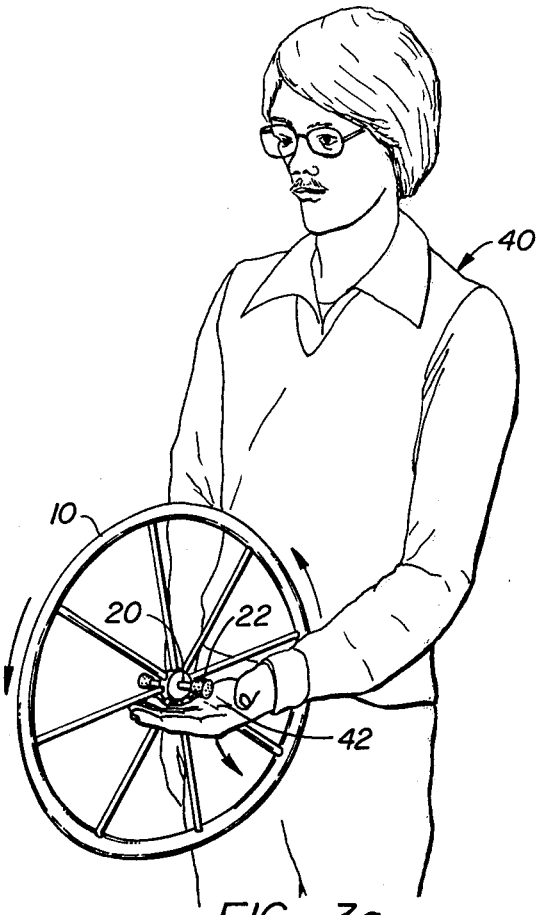
FIGS. 3a–3g are sequential views illustrating a typical maneuver by a user.
Figure 3B:
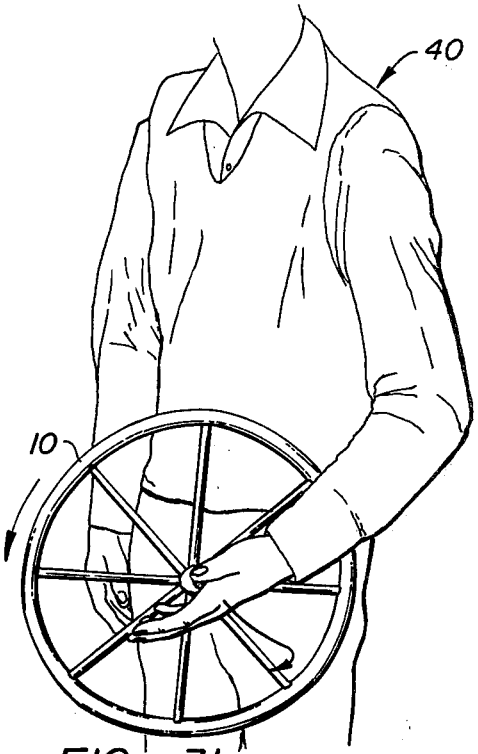
Figure 3C:
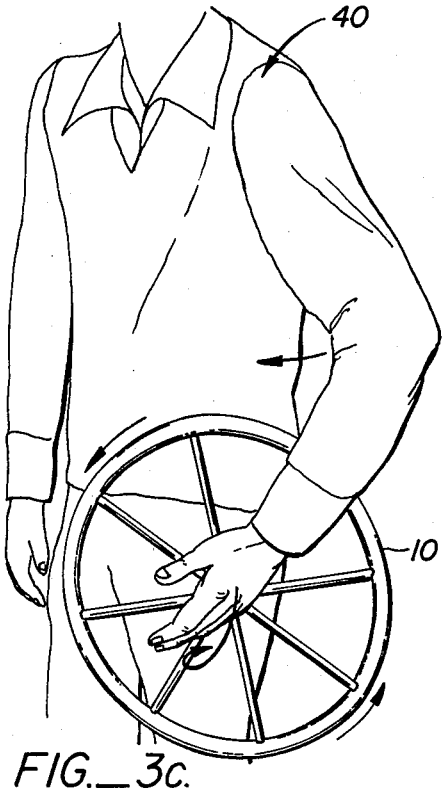
Figure 4:
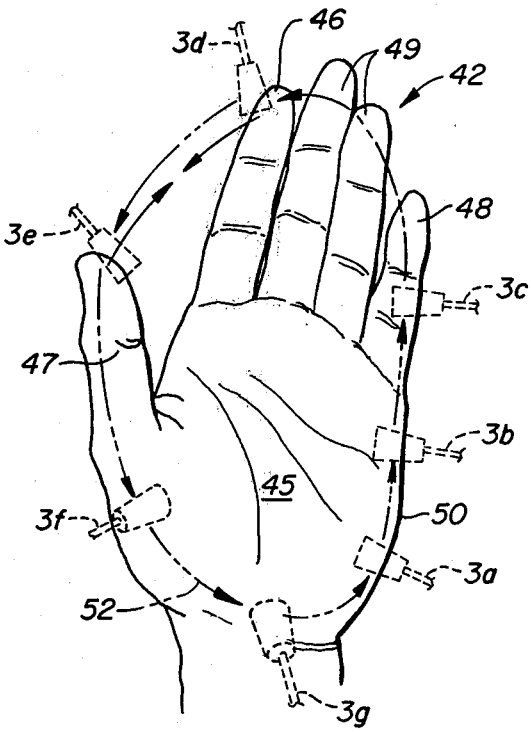
FIG. 4 is a plan view of the user's hand showing schematically the locations of the implement in the positions illustrated in FIGS. 3a–3g.

Referring to FIG. 3a, left hand 42 is in a generally open position with contact element 13 located at a position along palm edge 50 proximate heel 52. Palm 50 faces upward and the fingers are directed away from user 40. As implement 10 rolls towards the little finger 48, the precession causes it to veer to the right, necessitating a concurrent clockwise rotation of hand 42 to continue supporting the implement. Thus, as can be seen in FIGS. 3b and 3c, as contact element 13 rolls along the edge 50 of palm 45 onto little finger 48, a precession of approximately 90° has occurred, thereby necessitating a corresponding 90° rotation inward of left hand 42.

Figure 3D:
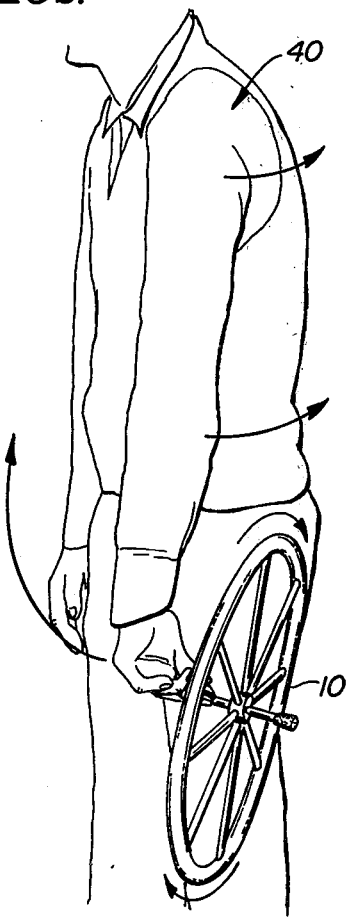
Figure 3E:
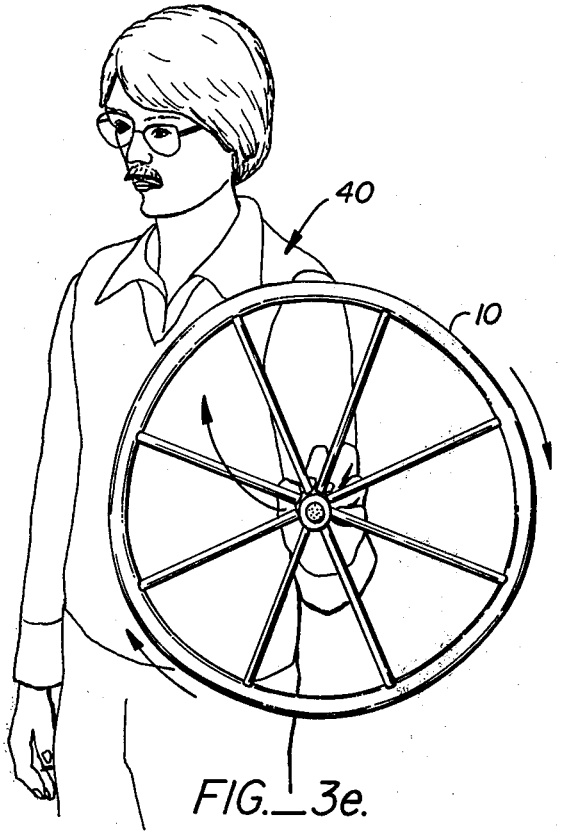
Figure 3F:
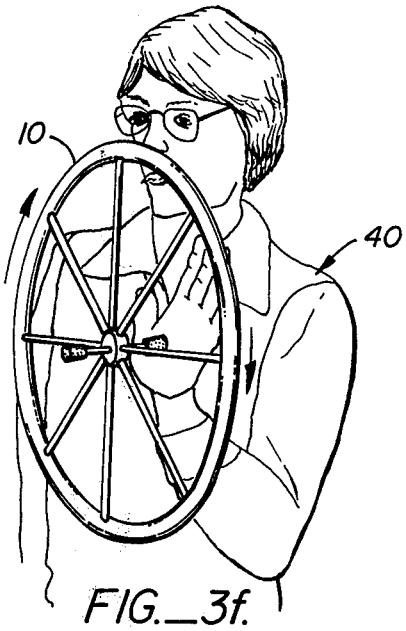
Figure 3G:
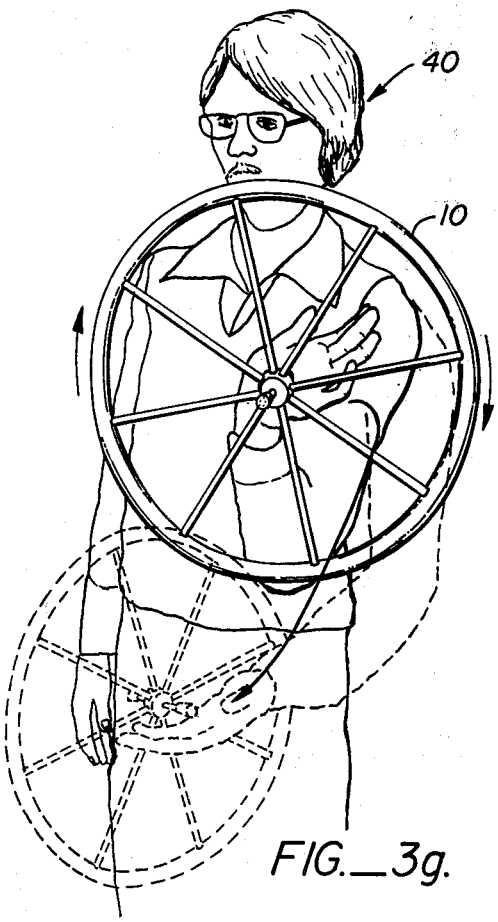

User 40 then causes the left hand 42 to rotate faster than the precessional angular velocity so that contact element 13 rolls over intermediate fingers 49, finally assuming a position on index finger 46 as shown in FIG. 3d. Referring to FIG. 3e, user 40 then places thumb 47 on contact element 13 and rotates hand 42 from the wrist 180° upward in order to transfer contact element 13 from index finger 46 to thumb 47. With reference to FIG. 3f, it can be seen that palm 45 is still facing generally upward, but with the fingers pointing generally back toward user 40. Implement 10 then rolls down the thumb and across heel 52 of hand 42, as shown in FIG. 3g. It will be appreciated that in the position shown in FIG. 3g, implement 10 is approaching the initial position of FIG. 3a except that the user's hand is in an elevated position. User 40 may then lower hand 42, thereby returning to the initial position of FIG. 3a.

A further maneuver, not illustrated, involves movement along a user's right arm. During this maneuver, the user maintains his palm facing upward and initially supports contact element 13 so that rotation of implement 10 causes contact element 13 to roll toward the right elbow along the left side of the right forearm. The elbow is initially bent. The rolling causes a clockwise precession which must be accompanied by a corresponding clockwise rotation (as viewed from above) of the forearm in order that implement 10 roll uniformly along the forearm. Thus, by the time implement 10 has traveled approximately halfway along the forearm, the forearm must have pivoted approximately 90° clockwise from the elbow in order to maintain support. Initially the right arm is bent at a 90° angle so that the 90° bend from the elbow generally straightens the arm out. A further 90° rotation of the entire arm from the shoulder occurs so that the forearm has pivoted a total of 180° concurrently with a 180° precession of the axis of rotation. During this time, contact element 13 will have rolled generally from the little finger to a position proximate the elbow (approximately 20 inches).

During operation of implement 10, as exemplified by the above described maneuvers, the motion is characterized by three kinematic quantities of interest, namely the angular velocity of implement 10 about the axis of shaft 12, the precessional angular velocity about a vertical axis, and the translational velocity of contact element 13 as it rolls along an appropriate portion of the user's anatomy. These quantities are referred to as $\omega$, $\Omega$, and v, respectively. As will be shown below, these kinematic quantities are not independent, but are related by the dimensional parameters R, L, and D, and the laws of physics governing rotational motion of rigid bodies. In particular, it may be shown that when implement 10 is rotating at angular velocity $\omega$ about a horizontal axis, the weight of implement 10 acting at a distance L from the point of support causes a precession about a vertical axis with the precessional angular velocity $\Omega$ given by:

$$\Omega = gL/R^2\omega \qquad \text{(Eqn. 1)}$$

where g is the acceleration of gravity.

The rotation of implement 10 about the shaft axis is related to the linear movement of contact element 22 by the constraint that contact element 22 roll without slipping so that:

$$v = \omega D/2 \qquad \text{(Eqn. 2)}$$

Dividing Eqn. 1 by Eqn. 2, and rearranging, leads to the following relationship:

$$L/R^2D = [1/2g](\Omega/v)\omega^2 = 0.0013(\Omega/v)\omega^2 \qquad \text{(Eqn. 3)}$$

where all lengths are expressed in inches and angles in radians. This equation is interesting since the lefthand side is an expression composed of dimensional variables only while the righthand side is an expression composed of kinematic quantities only. As will be now shown, certain constraints on these kinematic quantities lead to effective limits on the quantity $L/(R^2D)$.

Generally, implement 10 does not rotate more slowly than approximately one revolution/second because it would become unstable and difficult to control due to insufficient gyroscopic resistance. Moreover, a rotational speed of more than five revolutions/second is unlikely because the user would become fatigued from having to impart such fast rotation. Thus, while rotational rates outside this range are possible, the most comfortable, easily obtainable, and useful range for $\omega$ appears to be from 1.5–4 revolutions/second, which is equivalent to approximately 9–25 radians/second.

Directly associated with the operation of implement 10 in accordance with the spirit of this invention is the ratio $(\Omega/v)$ which gives the amount of angle precessed for a given distance travelled. Throughout a maneuver, the location of contact element 13 on the user's body and the direction of the axis of shaft 12 relative to the coronal plane of the user must be properly coordinated in order for the user to be physically able to continuously maintain some part of his anatomy underneath and slightly in front of the rolling contact element without bumping against rim 15. In particular, experience has shown that practical and useful values for the above mentioned ratio appear to range from approximately 0.14–0.60 radians precessed per inch rolled. For example, during the execution of the hand maneuver illustrated in FIGS. 3a–3g, the axis of rotation precesses one rotation (approximately 6.28 radians) while contact element 13 rolls approximately 13 inches, corresponding to approximately 0.5 radians/inch. During the execution of the arm maneuver described briefly above, the axis of rotation precesses approximately 180° (3.14 radians) while contact element 13 rolls approximately 20 inches, corresponding to 0.16 radians/inch.

Equation 3 can be rearranged so that the ratio $(\Omega/v)$ of angle precessed for distance rolled is given in terms of the other variables. In particular, $$(\Omega/V) = \frac{2gL}{R^2D}\ \frac{1}{\omega^2} \qquad \text{(Eqn. 4)}$$

Therefore, it can be seen that the ratio is inversely proportional to the square of the rotational velocity $\omega$, so that the user is able to control the ratio by controlling the rotational velocity—increasing the rotational velocity decreases the amount of precession per distance rolled and vice versa.

Table 1 shows values for the quantity $0.0013(\Omega/v)\omega^2$ when $(\Omega/v)$ and $\omega$ vary over the approximate ranges described above. Although the values for $(\Omega/v)$ and $\omega$ can change from one maneuver to another and even during a particular maneuver, the value of $0.0013(\Omega/v)\omega^2$ remains relatively constant because the physical dimensions of an integrally rigid implement do not ordinarily vary appreciably.

TABLE 1

| | | Values for $.0013\ (\Omega/v)\omega^2$ in inch$^{-2}$ | | | | | | | |
|---|---|---|---|---|---|---|---|---|---|
| | | $\omega$ in radius per second | | | | | | | |
| | | 9 | 11 | 13 | 15 | 17 | 19 | 21 | 23 |
| $(\Omega/v)$ in radians per inch | ½ | .05 | .08 | .11 | .15 | .19 | .23 | .29 | .34 |
| | ⅓ | .04 | .05 | .07 | .10 | .13 | .16 | .19 | .23 |
| | ¼ | .03 | .04 | .05 | .07 | .09 | .12 | .14 | .17 |
| | 1/5 | .02 | .03 | .04 | .06 | .08 | .10 | .11 | .13 |
| | 1/6 | .02 | .03 | .04 | .05 | .06 | .08 | .10 | .11 |
| | 1/7 | .01 | .02 | .03 | .04 | .05 | .07 | .08 | .10 |

An analysis of Table 1 reveals that the complete ranges of $(\Omega/v)$ and $\omega$ cannot be simultaneously achieved, but that generally a major part of each range will be available to the user when the quantity $0.0013(\Omega/v)\omega^2$ lies in the range approximately 0.05–0.11 inch$^{-2}$. An intermediate value within this range, namely 0.08 inch$^{-2}$ is typical and affords substantially the entire ranges of kinematic variables of interest.

Practical considerations also put constraints on the values of the dimensional variables L, R, and D.

A lower limit on the value of the moment arm, L, arises from the nature of certain maneuvers. The user, trying to continuously position some part of his anatomy underneath the rolling contact element, frequently has to pivot that part of his anatomy about the point of support of the contact element. In order to effect such a pivot without bumping against the rotating mass, the contact element must project outwardly from the implement at least a distance of approximately 1 inch. Furthermore, ease in pivoting requires an outward projection of at least half the distance across the user's palm, which will depend somewhat on the size of the user. An upper limit of the value of moment arm L arises during some maneuvers which require the user to change the point of support of from the distal end of the shaft to point adjacent the mass. This change becomes increasingly difficult as the length of the moment arm exceeds approximately 4 inches. A range of approximately 1.5–3 inches for L is reasonable.

Notice that a change in the point of support of the shaft assembly changes the rate of precession without altering the rotational velocity. Many maneuvers require the user to support the distal end of the shaft assembly. Increasing the length of the shaft assembly increases the rate of precession, which rate needs to remain within the aforementioned range. Although the effect caused by increasing the length of the shaft assembly can be compensated for by increasing the radius of gyration, many maneuvers involve passing the implement under the arm and thus requires that the overall radius of implement 10 be significantly less than the length of the user's arm. Thus, the radius of gyration R must be even less than this. An overall range of approximately 3–13 inches is feasible, with 5–9 inches being preferred.

Table 2 shows the values of the diameter D of contact element 13 for values of R and L lying in the above-mentioned ranges and wherein the value of $L/(R^2D)$ equals 0.08 $inch^{-2}$.

TABLE 2

Values for D in inches satisfying the equation $.08 = L/(R^2D)$

| | | Radius of gyration R in inches | | | | | |
|---|---|---|---|---|---|---|---|
| | | 3 | 5 | 7 | 9 | 11 | 13 |
| Moment arm L in inches | 1 | 1.4 | .5 | .26 | .15 | .10 | .08 |
| | 1.5 | 2.1 | .75 | .38 | .23 | .15 | .11 |
| | 2 | 2.8 | 1.0 | .51 | .31 | .21 | .13 |
| | 2.5 | 3.5 | 1.25 | .64 | .39 | .26 | .19 |
| | 3 | 4.2 | 1.5 | .77 | .46 | .31 | .22 |
| | 3.5 | 4.9 | 1.75 | .89 | .54 | .36 | .25 |
| | 4 | 5.6 | 2 | 1.02 | .61 | .41 | .31 |

Inspection of the values in Table 2 indicate that values for D lie in the range of 0.08–5.6 inches. However, a narrower range of values of D arises from the need to maintain the linear velocity v within reasonable limits. In particular, rates of linear movement less than approximately 1 inch/second are possible but tend to draw maneuvers out for an unduly long time. Such longer periods of time between occasional accelerations cause implement 10 to lose momentum and stability. As the linear velocity increases beyond approximately 12 inches/second, maneuvers become increasingly difficult to execute gracefully and require progressively greater dexterity for proficiency of operation. In order that the linear velocity remain below approximately 12 inches/second when the angular velocity $\omega$ is as high as 23 radians/second, the diameter D must be less than approximately 1.05 inches. Similarly, in order that the linear velocity remain above approximately 1 inch/second when the angular velocity $\Omega$ drops as low as 9 radians/second, the diameter D must be above approximately 0.22 inches. A more practical range is approximately $\frac{3}{8}$–1 inch, which values lie within the dashed outline in Table 2.

Although the actual mass of implement 10 does not enter into the equations and constraints discussed above, practical considerations dictate a range of 3–12 ounces. The lower end of the range arises from manufacturing and stability factors; the upper end arises from considerations of avoiding user fatigue.

In summary, it can be seen that the present invention provides an anatomically manipulable toy whose operation combined with anatomical considerations determines a number of dimensional ranges. While two exemplary maneuvers have been described, the number of maneuvers possible with such an implement is bounded only by the user's imagination.

While the above provides a full and complete disclosure of the preferred embodiments of the invention, various modifications, alternate constructions, and equivalents may be employed without departing from the true spirit and scope of the invention. For example, contact elements 13 and 23 were assumed to be of equal size. This is not necessary, since the provision of contact elements of differing sizes on the same implement would allow a greater dynamic range of operation. Similarly, each individual contact element need not have a single well-defined diameter for contacting the user. Rather, more complex longitudinal sections could permit different contact diameters depending on the precise point of contact. Therefore, the above description and illustrations should not be construed as limiting the scope of the invention which is defined by the appended claims.

What is claimed is:

1. A manually rotatable, anatomically manipulable and supportable implement comprising:

rigid body means defining a radius of gyration R about an axis and being characterized by a center of gravity:

contact means for providing a point of support of said rigid body means on a portion of a user's anatomy, said contact means defining a rolling diameter D centered about said axis; and means for rigidly spacing said point of support from said center of gravity along said axis to define a distance L;

the overall dimensions of said implement and the dimensional parameters R, L, and D being sized to permit the user to execute maneuvers wherein said contact means undergoes rolling motion along an anatomical portion of said user while the gravitational torque acting about said center of gravity causes a precessional velocity that correlates with said rolling motion to permit said user to maintain some anatomical portion underneath said rolling contact means for significant precessional rotation without bumping against portions of said body means, and wherein said length L divided by the product of said diameter D and the square of said radius of gyration R is in the range of approximately 0.05 to 0.11 reciprocal inches squared to permit said maneuvers to be carried out over a substantial range of kinematic variables.

2. A manually rotatable, anatomically manipulable and supportable implement comprising:

rigid body means defining a radius of gyration R about an axis and being characterized by a center of gravity; and frictional contact means coupled with said body means and spaced from said center of gravity along said axis by a distance L for providing a point of rolling support for said rigid body means as said body means rolls relative to an anatomical portion of a user, said contact means defining a rolling diameter D centered about said axis;

said implement being configured for executed maneuvers wherein said contact means undergoes rolling motion at a translational velocity, designated v, along said anatomical portion of the user, the overall dimensions of said body means and said contact means and the dimensional parameters R, D, and L being sized such that the rotational velocity, designated $\omega$, of said implement about said axis and the gravitational torque acting on said center of gravity about said point of support cause said body means to undergo a precessional motion at an angular velocity, designated $\Omega$, that permits said user to maintain some anatomical portion underneath said rolling contact means without bumping against said body means for significant amounts of travel and precession and prolonged duration as said axis is maintained in a generally horizontal orientation, said dimensional parameters being further interrelated to permit said user to execute maneuvers with $\omega$ in a first range of 9–25 radians per second and the ratio $(\Omega/v)$ in a second range of 0.41–0.60 radians precessed per inch rolled, such that variation of $\omega$ over a major portion of said first range causes concomitant variation of $(\Omega/v)$ with the concomitant variation being over a major part of said second range.

3. The invention of claim 2 wherein said length L divided by the product of said diameter D and the square of said radius of gyration R is in the range of approximately 0.05 to 0.11 reciprocal inches squared.

4. The invention of claim 3 or 1 wherein R is in the range of 5–9 inches, D is in the range $\frac{3}{8}$–1 inch, and L is in the range 1.5–3 inches.

5. The invention of claim 1 or 2 wherein said radius of gyration is primarily defined by a wheel-like body member, and wherein said length L is primarily defined by a relatively small diameter shaft passing through the center of said body member.

6. The invention of claim 5 wherein said contact means is defined by a bushing of diameter D mounted coaxially to an end of said shaft.

7. The invention of claim 5 wherein said shaft has a diameter D at an end thereof to define said contact means.

8. The invention of claim 4 wherein said implement has a weight in the range of 3–12 ounces.

9. An anatomically manipulable toy comprising:

a rigid shaft;

a mass rigidly mounted to said shaft and extending radially outward therefrom; and a generally cylindrically symmetric end element mounted proximate an end of said shaft coaxially therewith to provide a point of rolling contact with a portion of a user's anatomy as said toy undergoes translational, rotational, and precessional motion;

said toy being characterized by the dimensional parameters R, L, and D where R is the radius of gyration of said toy about the axis of said shaft, L is the distance between the center of gravity of said toy and the point of contact between said user and said shaft end element, and D is the diameter of said end element, the overall dimensions of said toy and said parameters R, L, and D being sized to permit the user to execute maneuvers wherein said end element undergoes rolling motion along an anatomical portion of said user while the gravitational torque acting about said point of contact causes a precessional velocity that correlates with said rolling motion to permit said user to maintain some anatomical portion underneath said rolling end element for significant precessional rotation without bumping against portions of said mass, and wherein $L/(R^2D)$ is in the range of 0.05–0.11 $\text{inch}^{-2}$ to permit said maneuvers to be carried out over a substantial range of kinematic variables.

10. The invention of claim 9 wherein said mass has a wheel-like configuration coaxial about said shaft.

11. The invention of claim 9 wherein said shaft end element is removably secured to said shaft and is fabricated from a somewhat resilient frictional material.

12. The invention of claim 9 wherein said mass is mounted to an intermediate portion of said shaft so that said shaft extends away from said mass in both directions.

13. The invention of claim 9 wherein R is in the range of 5–9 inches, D is in the range of $\frac{3}{8}$–1 inch, and L is in the range of 1.5–3 inches.

* * * * *